United States Patent [19]

Brown

[11] 4,114,799

[45] Sep. 19, 1978

[54] SOLICITATION ENVELOPE CARRIER

[75] Inventor: William A. Brown, Omaha, Nebr.

[73] Assignee: Champion International Corporation, Stamford, Conn.

[21] Appl. No.: 813,836

[22] Filed: Jul. 8, 1977

[51] Int. Cl.[2] ..... B65D 27/08

[52] U.S. Cl. ..... 229/72

[58] Field of Search ..... 229/72, 56, 75, 68 R

[56] References Cited

U.S. PATENT DOCUMENTS

| | | | |
|---|---|---|---|
| 937,315 | 10/1909 | Lueneburg | 229/68 R |
| 1,163,459 | 12/1915 | Rheutan | 229/72 |
| 1,589,713 | 6/1926 | Overly | 229/72 |
| 1,751,216 | 3/1930 | Rife | 229/72 |
| 2,354,820 | 8/1944 | McCarty | 229/72 |
| 2,749,021 | 6/1956 | Hiersteiner | 229/72 |
| 3,140,817 | 7/1964 | Fitzgerald | 229/72 |

FOREIGN PATENT DOCUMENTS

| | | | |
|---|---|---|---|
| 20,979 of | 1906 | United Kingdom | 229/75 |

*Primary Examiner*—Stephen P. Garbe
*Attorney, Agent, or Firm*—Evelyn M. Sommer

[57] ABSTRACT

A carrier for accomodating solicitation envelopes is preferably 8 by 11 inches and includes a 5 inch overlapping flap. An off-set center seam construction results in two different size pockets, the small pocket being sufficient to accommodate a letter of instructions, brochures, and empty contribution envelopes. Each contributor takes a contribution envelope from the smaller pocket, encloses contributions, and inserts the filled bulky envelope into the larger pocket of the carrier. The construction of the solicitation envelope carrier facilitates and aids the soliciter in handling of both the empty and bulky envelopes. The solicitation envelope carrier is formed of a single blank having overlapping end and bottom panels for defining the two different size pockets, as well as the overlapping flap.

4 Claims, 3 Drawing Figures

SOLICITATION ENVELOPE CARRIER

The present invention relates to a new and improved carrier for envelopes, and more particularly, a new and improved solicitation envelope carrier having two different size pockets, one being sufficient to carry a number of solicitation envelopes that are empty, and the second, larger, pocket adapted to carry the solicitation envelopes after contributions have been received and the solicitation envelopes are larger and bulkier. The arrangement of the different size pockets, the latex adhesive for releasably connecting the flap to the body of the solicitation envelope carrier, and other features provide an extremely efficient and economical carrier for use by the volunteer engaged in house-to-house solicitation of contributions.

Heretofore, a block volunteer has normally been provided with a conventional large size envelope, having a single pocket for carrying both empty and filled envelopes. In general the carrier envelope having only one pocket has not been too efficient for the volunteer to readily obtain either a blank envelope, or to keep track of the number of envelopes that contain contributions.

In order to provide the block volunteer with a more efficient system, and more particularly a more efficient solicitation envelope carrier, the subject invention provides a solicitation envelope carrier suitable for simultaneously carrying both empty and filled bulky envelopes in separate designated pockets. In general, the subject carrier includes a front panel of generally rectangular shape, first and second end panels which are respectively connected to the opposite side edges of the front panel, with the first end panel being less than one-half the width of the front panel. On the other hand, the second end panel is greater than one-half the width of the front panel. The first end panel is bonded to the face of the front panel, and in turn, the second end panel overlaps and is bonded to the first end panel. A bottom panel overlaps both the first and second end panels and is bonded thereto, thereby defining, with the front face, a small pocket for accommodating empty solicitation envelopes, and a larger pocket for accommodating filled bulky solicitation envelopes.

Further objects and advantages of the subject invention will become apparent from a reading of the following detailed description taken in conjunction with the drawings in which.

Figure 1:
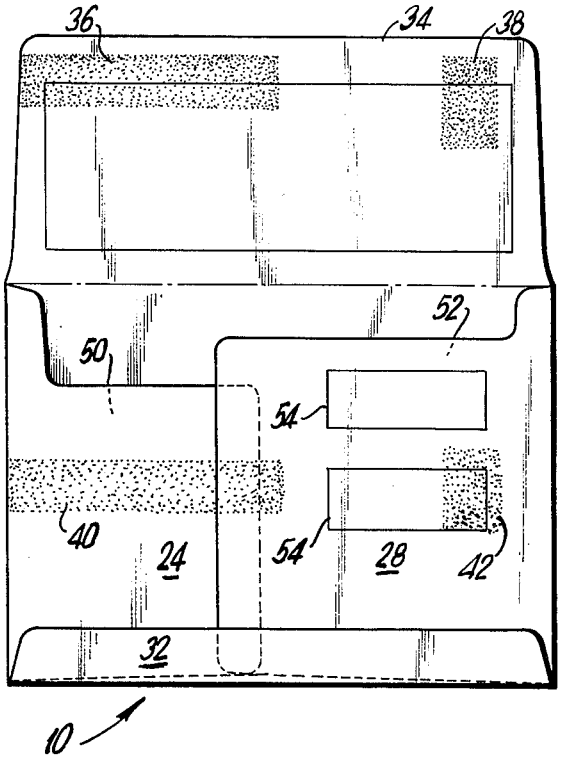
FIG. 1 is an elevational view of the back portion of the subject solicitation envelope carrier, and illustrating the flap in its unfolded position.
Figure 2:
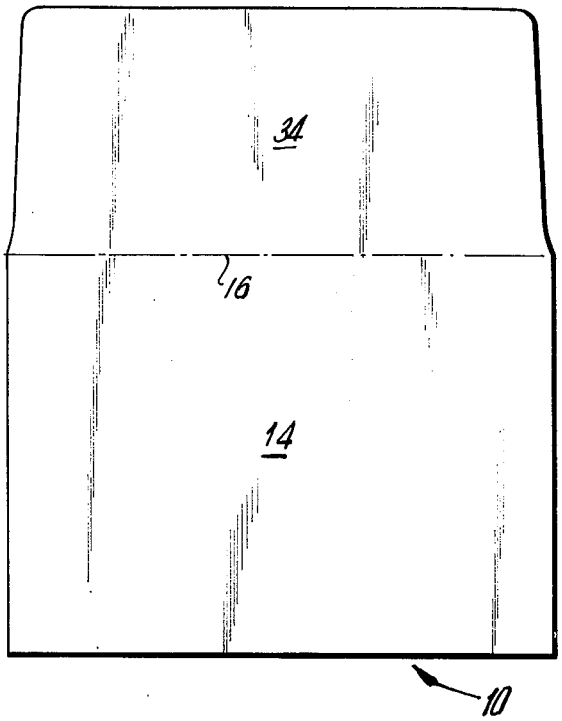
FIG. 2 is a front elevational view of the subject solicitation envelope carrier, again with the flap in its unfolded position.
Figure 3:
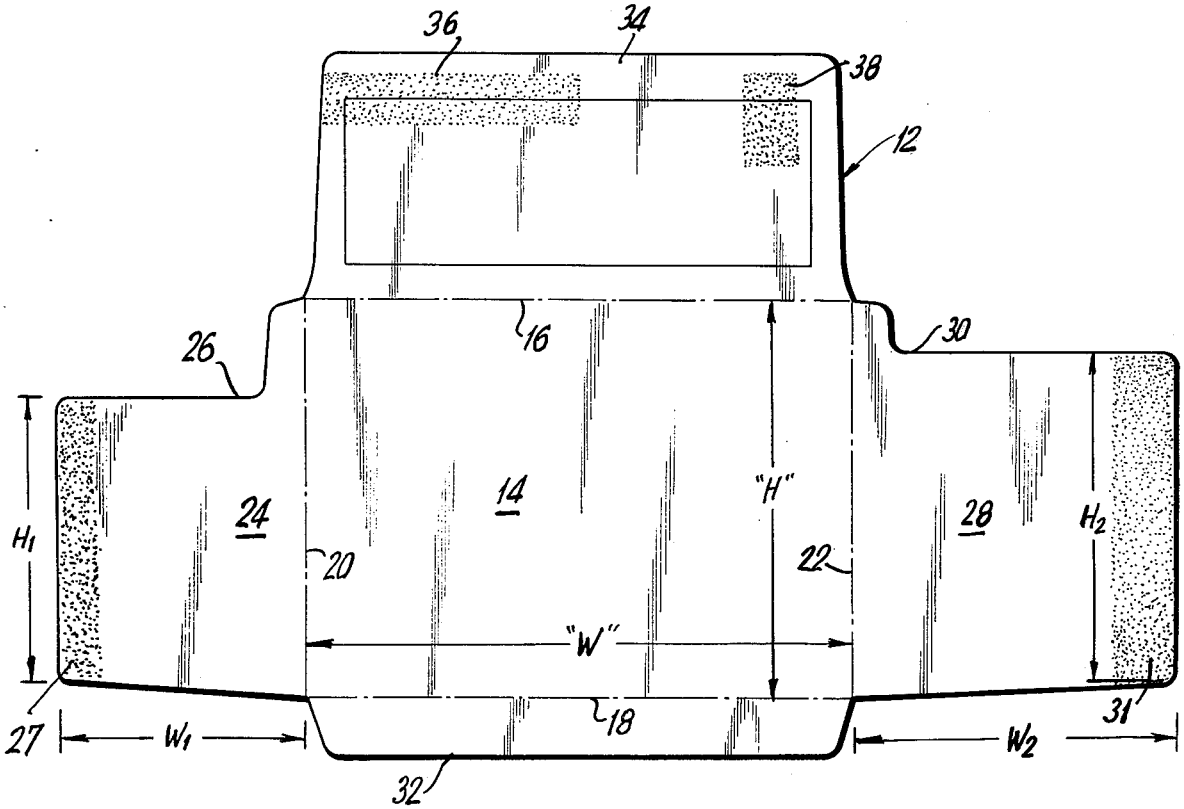
FIG. 3 is an elevational view of the blank for forming the subject solicitation envelope carrier.

Referring to FIGS. 1–3, the solicitation envelope carrier of the subject invention is designated by the numeral 10 and is formed of a single blank 12, preferably made of a paper stock of 24 pounds weight. As illustrated in FIG. 3, the blank 12 includes a front panel 14 of generally rectangular configuration including a height "H" of 8 inches, and a width "W" of 11 inches. The front panel includes a top edge 16, bottom edge 18, and opposed side edges 20 and 22. Hingedly connected to the side edge 20 is a first end panel 24 having a width "$W_1$" which is less than one-half the width "W" of the front panel 14. The first end panel includes a cut out portion 26 such that the height "$H_1$" of the main portion of the end panel 24 is less than the total height "H" of the front panel 14. Adhesive 27 is provided along the free edge of the first panel 24. Hingedly connected to the opposite side edge 22 of the front panel 14 is a second end panel 28 including a cut-out portion designated by the numeral 30. The width "$W_2$" of the second end panel is greater than one-half the width "W" of the front panel, and the height "H2" of the second end panel 28 is greater than the height "H1" of the first end panel. Adhesive 31 is provided along the free edge of the second end panel 28. Hingedly connected to the bottom edge 18 of the front panel 14 is a bottom panel 32, while a top panel 34 is hingedly connected to the top edge 16. The top panel 34 includes on its inside surface latex adhesive strips 36 and 38 which are positioned to releasably engage with similar strips of adhesive 40 and 42 respectively disposed on the back portions of the second and first end panels as shown in FIG. 1.

In the assembly of the solicitation envelope carrier of the subject invention, initially the first end panel 24 is folded about the hinge line 20 and bonded by adhesive 27 to the face of the front panel 14. Next, the second end panel 28 is folded about the edge 22 and is bonded to the first end panel by adhesive 31. The bottom panel 32 is then folded about the bottom edge 18 and closes the bottom edge of the resulting solicitation envelope carrier, and at the same time forms a small pocket 50, and a large pocket 52. The different sizes of the pockets is achieved by virtue of the variation in width and height respectively of the first and second end panels. Suitable indicia 54 may be provided on the envelope as required to aid the volunteer in house-to-house solicitation of conributions.

In use, the solicitation envelope carrier is initially provided to the volunteer, with a letter of instructions, brochures, and from 10 to 20 contribution envelopes, all provided in the small pocket 50 formed by the first edge panel 24. Labels are affixed to the outside of the large pocket 52, at the places designated by the indicia 54 to aid the volunteer by indicating the block assignment and name of the potential contributors. Each contributor takes a contribution envelope from the left hand or small pocket 50, encloses a contribution and inserts the contribution envelope into the right hand or large pocket 52. The larger right hand pocket 52 allows for the bulkiness of the contribution envelopes with the money enclosed. At all times the volunteer maintains the empty solicitation envelopes and the filled bulky envelopes in the respective pockets, thereby greatly aiding the volunteer in keeping track of empty and filled contribution envelopes as he proceeds from house-to-house in the solicitation of contributions.

While a preferred environment has been shown and described, it will be understood that there is no attempt to limit the invention by such disclosure but, rather, it is intended to cover all modifications and alternate constructions falling within the spirit and scope of the invention as defined in the appended claims.

What is claimed is:

1. A solicitation envelope carrier suitable for simulataneously carrying empty and filled bulky envelopes comprising:

a front panel of generally rectangular shape having top, bottom, and side edges;

a first end panel hingedly connected to one side edge of the front panel and being less than one-half the width of said front panel, said first end panel being bonded along its edge opposite to said hingedly connected edge to the face of said front panel;

a second end panel hingedly connected to the opposite side edge of the front panel and being greater than one-half the width of the front panel, said second end panel overlapping and being bonded to said first end panel;

a bottom panel hingedly connected to said bottom edge of the front panel and overlapping and being bonded to said first and second edge panels so as to define with said front panel and said first and second end panels a small pocket and a large pocket for accomodating empty and filled bulk envelopes respectively; and a top panel forming a flap that is hingedly connected to the top edge of the front panel.

2. A solicitation envelope carrier suitable for simultaneously carrying empty and filled bulky envelopes as in claim 1 wherein latex adhesive is applied to said first and second end panels, and also to the contiguous portions of the top panel for maintaining the top flap panel in its folded position.

3. A solicitation envelope carrier suitable for simultaneously carrying empty and filled bulky envelopes as in claim 1 wherein the height of the larger pocket extending between the bottom and top edges of the front panel is greater than the height of said small pocket.

4. A solicitation envelope carrier suitable for simultaneously carrying empty and filled bulky envelopes as in claim 2 wherein said latex adhesive applied to the flap includes two strips, one extending parallel to the top edge of the front panel, and the other extending perpendicular to said top edge.

* * * * *